US005214475A

United States Patent [19]

Ishii et al.

[11] Patent Number: 5,214,475

[45] Date of Patent: May 25, 1993

[54] METHOD AND APPARATUS FOR DETECTING RESIDUAL QUANTITY OF TONER IN IMAGE FORMING DEVICE

[75] Inventors: Masato Ishii; Hirohiko Kubo, both of Kawasaki, Japan

[73] Assignee: Fujitsu Limited, Kawasaki, Japan

[21] Appl. No.: 791,126

[22] Filed: Nov. 13, 1991

[30] Foreign Application Priority Data

Nov. 13, 1990 [JP] Japan ..... 2-306841

[51] Int. Cl.[5] ..... G03G 21/00

[52] U.S. Cl. ..... 355/246; 355/206; 355/209; 118/689

[58] Field of Search ..... 355/203, 206, 209, 246; 118/688, 689

[56] References Cited

U.S. PATENT DOCUMENTS

| | | | |
|---|---|---|---|
| 4,647,185 | 3/1987 | Takeda et al. | 355/246 X |
| 4,758,861 | 7/1988 | Nakamura et al. | 355/246 X |
| 4,901,115 | 2/1990 | Nakamura et al. | 355/246 |
| 4,903,051 | 2/1990 | Egawa et al. | 355/246 X |

FOREIGN PATENT DOCUMENTS 62-182733 7/1987 Japan .

*Primary Examiner*—Michael L. Gellner
*Assistant Examiner*—P. Stanzione
*Attorney, Agent, or Firm*—Staas & Halsey

[57] ABSTRACT

An image forming apparatus includes a developing unit and a photoconductive drum. A toner sensor is disposed in a toner mixing chamber of the developing unit. A mixing member is included in the chamber for mixing and frictionally charging the toner. A detection device is mounted on the unit for detecting the residual quantity of density of the toner according to the output voltage of the sensor. The residual quantity or density of the toner is detected by sampling an output voltage of the toner sensor at predetermined times during a predetermined period while the mixing member is rotated at a specific constant speed, and averaging the sampled vales. As a result correct data for the residual quantity or density of the toner can be obtained.

40 Claims, 11 Drawing Sheets

METHOD AND APPARATUS FOR DETECTING RESIDUAL QUANTITY OF TONER IN IMAGE FORMING DEVICE

BACKGROUND OF THE INVENTION

1. Field of the Invention

The invention relates to a method and apparatus for detecting the residual quantity of toner in an image forming device, and particularly to a method and apparatus for detecting the amount of toner in image forming devices such as electrophotographic printers and copy machines in which the toner is mixed by a mixing member during the printing operation.

2. Description of the Related Art

Generally, in image forming devices such as electrophotographic printers, copy machines and fax machines, an electrostatic latent image corresponding to an image to be printed or copied is optically formed on a photoconductor drum. The latent image is then developed with a toner into a toner image, which is transferred to and fixed on a recording sheet to complete the printing or copying operation. As the printing or copying operation is repeated, the toner is gradually consumed. When the toner is reduced below certain level, the printed or copied image becomes thinned out so as to provide an unclear printed or copied image. It is usual, therefore, to detect the residual quantity or density of the toner using a toner sensor disposed at a toner mixing chamber wherein a mixing member is turned for mixing and frictionally charging the toner. The toner sensor detects the residual quantity or density of the toner mixture and provides an output voltage in accordance with the amount of the toner.

Usually, the image forming device is equipped with at least one toner indicator for indicating a need for replenishment of the toner or replacement of a toner container. When the quantity or density of the toner drops below a specified value, the toner indicator is actuated to inform the user to replenish the toner or replace the toner container.

FIG. 1 is a cross-sectional view of a conventional developing unit of the sort often employed for electrophotographic printers etc. As seen in FIG. 1, the unit includes a developing unit 1, and a photoconductor drum 2. The developing unit 1 has a mixing chamber 10 where the toner 9 is mixed and charged by friction, a toner separating portion 20, and a toner sensor 30.

A toner mixing member 11 is mounted in chamber 10 for stirring and frictionally charging the toner 9. The toner 9 is fed to a magnet roll 21 of the toner separating portion 20. As magnet roll 21 is rotated, the toner 9 is carried on the surface thereof. The thickness of the toner on the roll 21 is regulated by a doctor blade 22. The toner then comes into contact with the surface of the photoconductor drum 2 facing the magnet roll. A bias voltage is applied to the magnet roll 21 and the toner is transferred onto a electrostatic latent image formed on the surface of the photoconductor drum to thereby form a toner image according to the difference between the bias voltage and the surface potential of drum 2.

FIG. 2 is a perspective view illustrating the mixing member 11 of FIG. 1. Mixing member 11 includes a rotational shaft 11*c* which carries four arms 11*a*. Two of the arms 11*a* are mounted on the same side of the shaft 11*c* and the other two arms 11*a* are mounted on the opposite side thereof. The free ends of the arms 11*a* are connected by two bars 11*b*.

As shown in FIG. 3, toner sensor 30 is attached to the toner container 12 so as to detect the residual quantity or density of the toner in chamber 10. As shown in FIG. 4 toner sensor 30 comprises a differential transformer having a drive coil L1, a reference coil L2, and a detection coil L3. These coils L1, L2 and L3 are wound around the same core 31. A high-frequency signal of 500 KHz is applied to the drive coil L1 from an oscillator OSC.

There are two types of developers for image forming device. One type is a single component developer consisting only of the toner, and the other types is a two-component developer which contains the tone and a magnetic carrier such as ferrite or iron. Recently, a new type of two-component developer has become known, wherein the rate of usage of the carrier is very small as compared with the rate of usage of the toner. This new type of two-component developer is sometimes referred to as a 1.5 component developer.

When a two-component developer which is a mixture of magnetic carrier and the nonmagnetic toner is used, when the relative amount of the toner is high in a given volume, the relative amount of the magnetic carrier substances to too low to cause an increase in the magnetic resistance of the developer. On the other hand, if the relative amount of the toner becomes lower in the same volume, the relative amount of the carrier increases so as to reduce the magnetic resistance. The output voltage of the detection coil L3 changes in response to the relative amount (density) of the toner in the mixture, and the output voltage Vo of the toner sensor changes accordingly. Thus, the density of the toner is detachable according to the output voltage Vo of the toner sensor 30.

When the 1.5 component developer, which is a mixture of a small quantity of magnetic carrier and a large quantity of the nonmagnetic toner is used, the toner sensor 30 cannot detect the density of the toner. However, as the toner is consumed, the magnetic resistance of the developer changes depending on whether the developer is above, below, or around the surface of the toner sensor. Accordingly, the residual quantity of toner in the chamber 10 is detectable according to the output Vo of the toner sensor 30.

While the toner sensor 30 is detecting the residual quantity of the toner 9, the toner 9 is being stirred and moved by the mixing member 11. The output voltage Vo of the toner sensor 30, therefore, oscillates as shown in FIG. 5 as the mixing member 11 rotates. As shown in FIG. 5, the mixing member 11 starts to rotate at time t1, the rotational speed thereof becomes constant after time t2, and the printing operation of the image forming device is carried out between time t2 and t3. The rotational speed of the mixing member 11 decreases after time t3, and the mixing member 11 stops at time t4.

The amplitude of the output voltage Vo of the toner sensor 30 as a function of the acceleration or deceleration of the rotation of the mixing member 11. When the mixing member 11 ceases to rotate, the output voltage Vo of the toner sensor 30 indicates a high or low value. In a case where the mixing member 11 stops moving at a point where a large quantity of the toner 9 is disposed on the toner sensor 30, the output voltage Vo of the toner sensor 30 will be high. This condition is indicated by dot and dashed lines A in FIG. 3. If the mixing member 11 should stop just after passing over the toner sensor 30, the output voltage Vo of the toner sensor 30 will be low because the quantity of the toner 9 on the toner sensor 30 will have been reduced by the mixing member 11. This condition is indicated by the phantom lines B in FIG. 3.

In this way, the relationship between the toner 9 and the toner sensor 30 changes according to the rotational position of the mixing member 11. In conventional devices, the conditions described destabilize the output voltage of the toner sensor 30 and cause an incorrect detection of the residual quantity of the toner.

When detecting the density of the toner 9, the output voltage Vo of the toner sensor 30 also fluctuates depending upon the rotation of the mixing member 11. Thus, the output voltage Vo becomes larger or smaller depending on the stopping position of the mixing member 11, and therefore, the density of the toner 9 is not correctly detected.

SUMMARY OF THE INVENTION

An object of the invention is, therefore, to provide a tone quantity detecting method that correctly detects the residual quantity or density of toner.

According to the present invention, the output voltage of the toner sensor 30 is sampled at predetermined time periods after the rotational speed of the mixing member becomes constant. The average of the sampled values provides data which relates to the residual quantity or density of the toner. The predetermined number of sampled values taken during a certain time period may be substantially equal to a random number times the rotational period of the mixing member 11.

When the rotational speed of the mixing member 11 becomes constant, the output voltage Vo of the toner sensor 30 provides a regular waveform. In this condition, sampling of the output voltage of the toner sensor 30 is carried out at predetermined times during a predetermined period according to the present invention, and the sampled values are averaged to provide data which relates to the residual quantity or density of the toner. In this way, according to the present invention, the residual quantity or density of the toner is determined without being influenced by the stopping position of the mixing member 11.

When the residual quantity or density of the toner is sampled only after the mixing member 11 has reached a specific constant speed, clods of toner are separated into particles and toner sticking to walls is removed, so that the residual quantity and density of the toner may be more stably detected. The average of the sampled values of the output voltage of the sensor over a period of time that is a random number times the rotational period of the mixing member provides data relating to the residual quantity or density of the toner. The output voltage of the toner sensor, which oscillates, is sampled at various temporal points and averaged to provide stabilized data for the residual quantity or density of the toner. The thus averaged toner residual quantity values are compared with a near-empty value or an empty value, and a toner near end signal or a toner end signal is correctly provided.

BRIEF DESCRIPTION OF THE DRAWINGS

The present invention will be more clearly understood from the description as set forth below, with reference to the accompanying drawings wherein.

DESCRIPTION OF THE PREFERRED EMBODIMENTS

Figure 1:
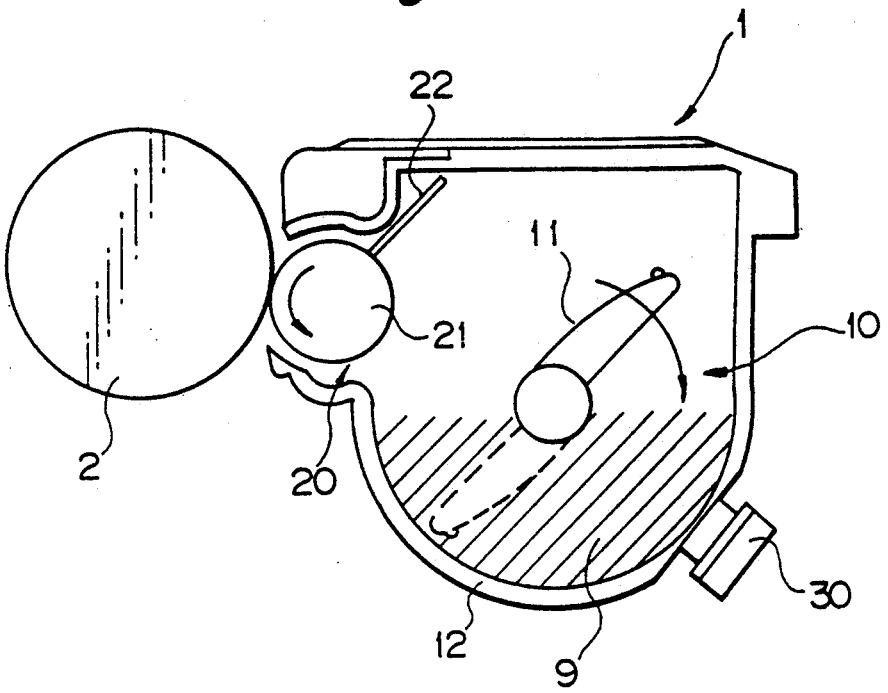
FIG. 1 is a cross-sectional view showing a conventional developing unit of an image forming device having a toner sensor.
Figure 2:
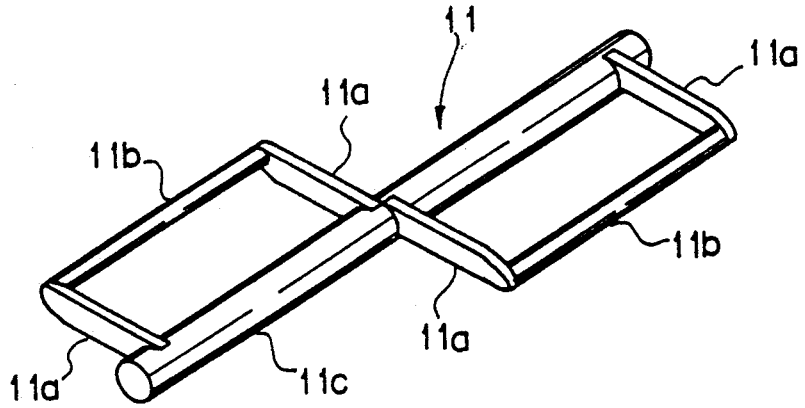
FIG. 2 is a perspective view illustrating the mixing member of FIG. 1.
Figure 3:
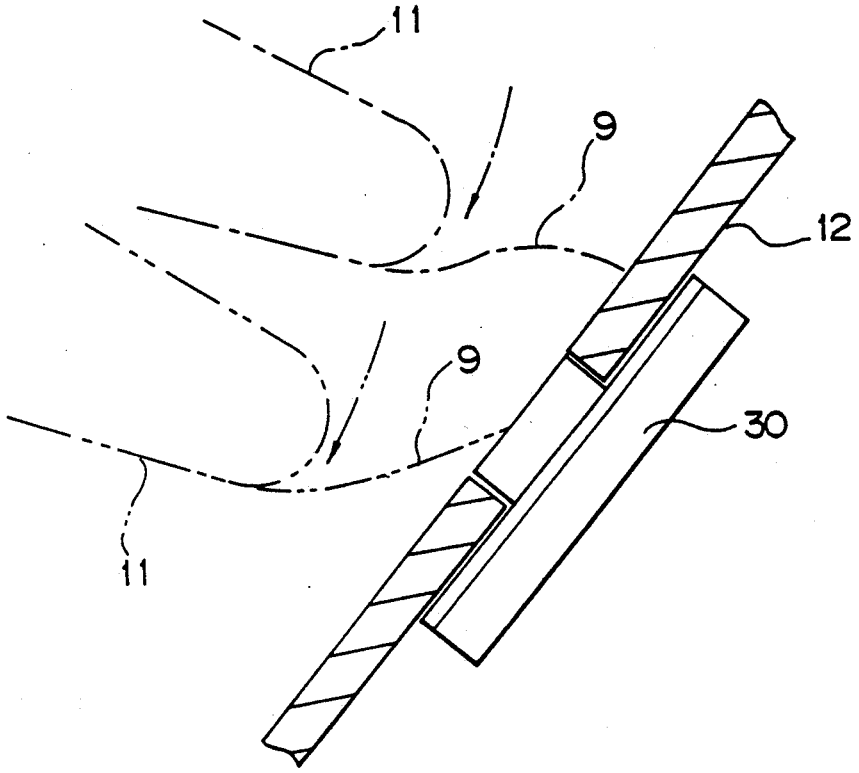
FIG. 3 is a schematic view illustrating the relationship between the stop position of the mixing member and the toner condition around the toner sensor.
Figure 4:
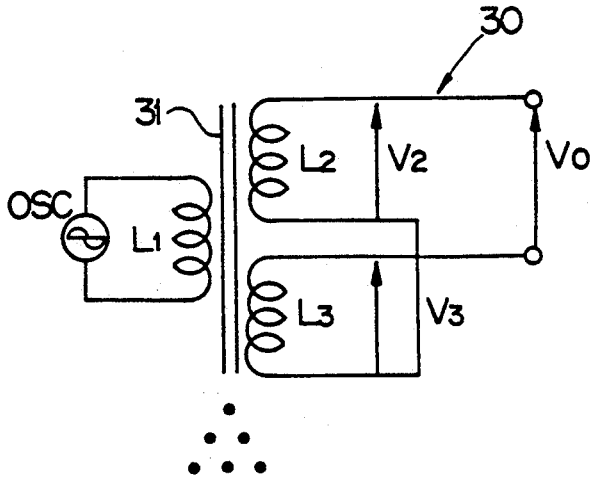
FIG. 4 is a conventional circuit diagram for the toner sensor.
Figure 5:
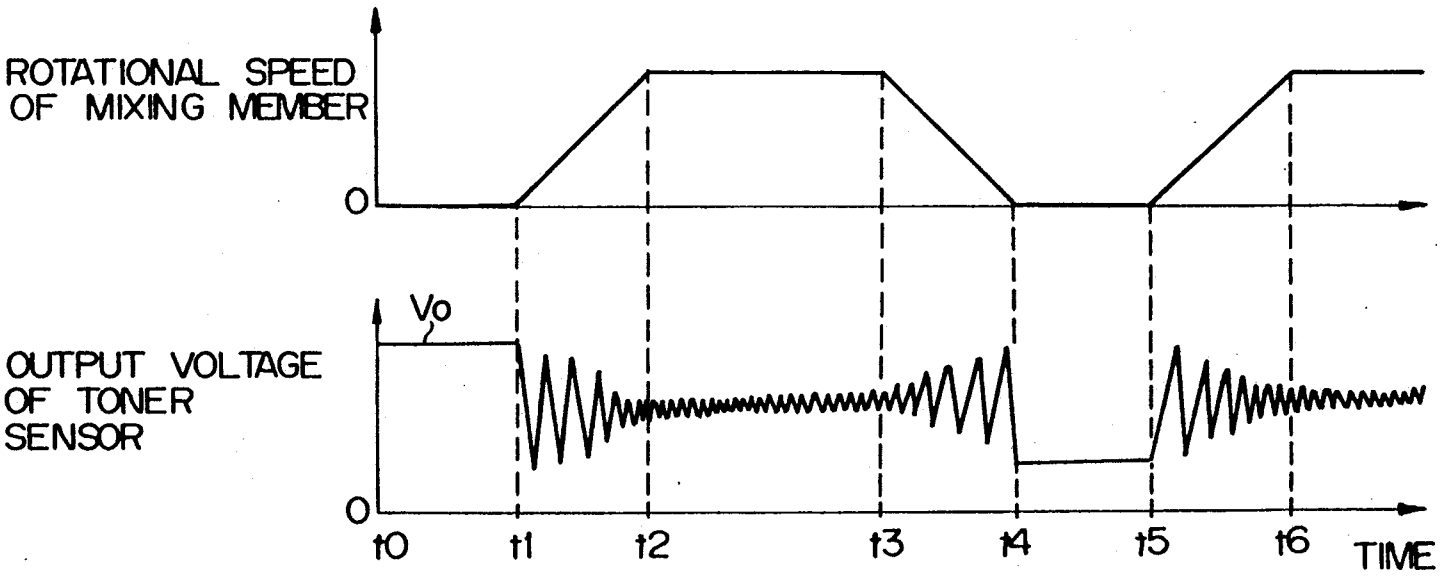
FIG. 5 is a diagram illustrating a prior art relationship between the rotational speed of the mixing member and the output of the toner sensor.
Figure 6:
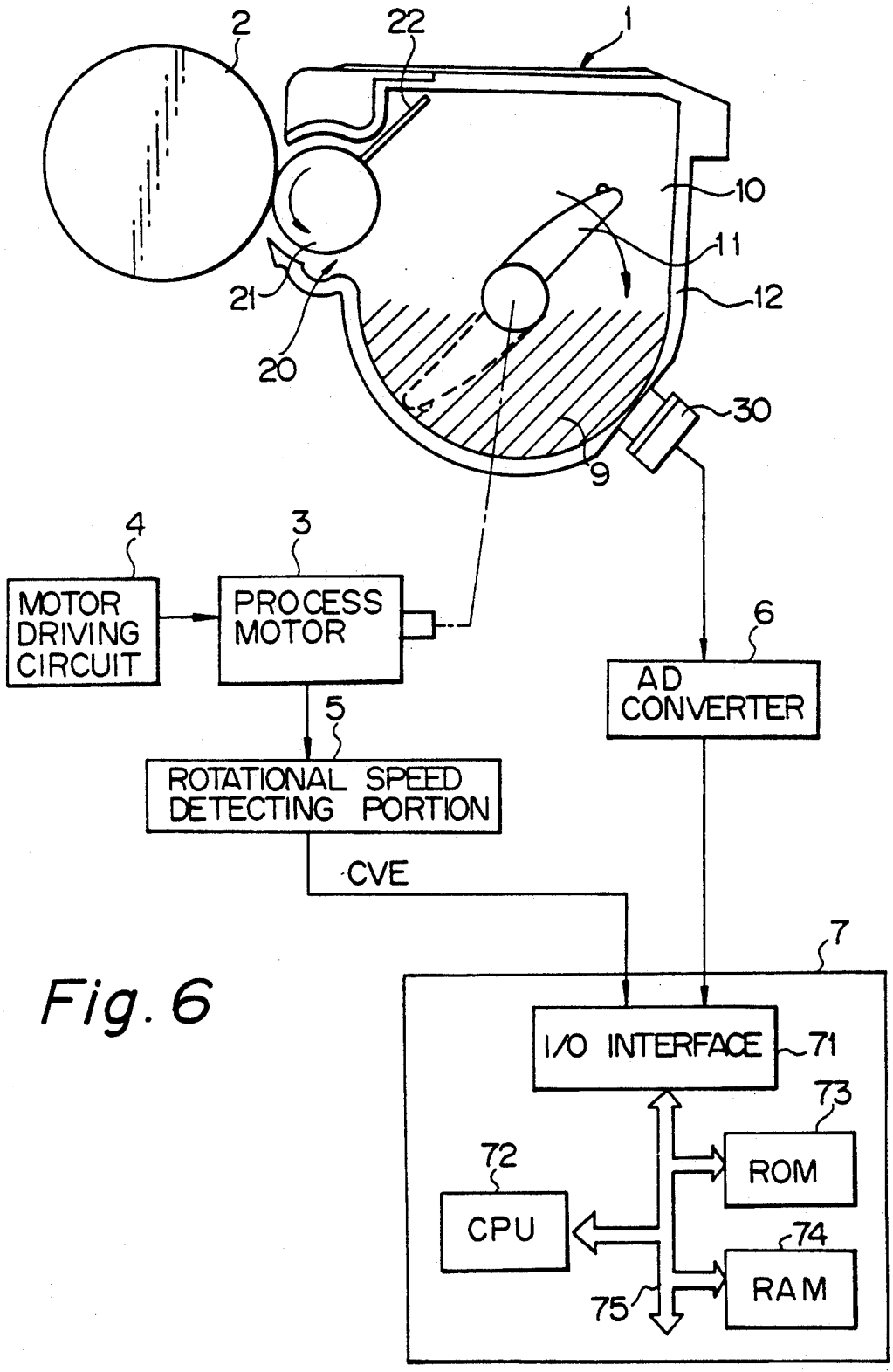
FIG. 6 is a schematic view showing one embodiment of the apparatus according to the present invention.

FIG. 6 is a schematic view showing an apparatus which embodies a toner detecting device in accordance with the present invention. The apparatus includes a developing unit 1, a photoconductor drum 2, a process motor 3 for rotating a mixing member a process motor driving circuit 4, a rotational speed detector 5 for detecting the rotational speed of the process motor 3 and providing a constant speed signal CVE once the motor speed reaches a specific speed, an AD converter 6 for converting the output of a toner sensor 30, and a signal processor 7 for averaging output values of the toner sensor 30 and providing data for the residual quantity (or density) of the toner 9.

Developing unit 1 has a mixing chamber 10 for mixing the toner 9 stored in toner container 12 with the mixing member 11 rotated by the process motor 3. Unit 1 has a toner separating portion which includes a magnet roll 21 for guiding the toner toward the photoconductor drum 2, and a doctor blade 22 for regulating the thickness of the toner. Toner sensor 30 is included for detecting the residual quantity or density of the toner 9. The toner 9 is, for example, a 1.5 component developer in this embodiment.

The signal processor 7 comprises a microcomputer which includes an input/output (I/O) interface 71, a central processing unit (CPU) 72, a read only memory (ROM) for storing a program, and a random access memory (RAM) for storing various data. The I/O interface 71, the CPU 72, the ROM 73, and the RAM 74 are interconnected by bus line 75.

Figure 7:
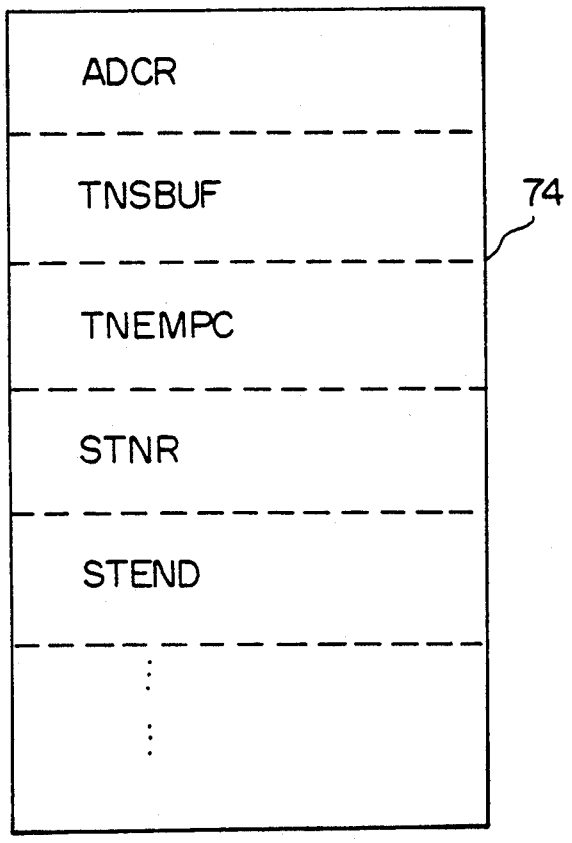
FIG. 7 is a schematic diagram showing the content of the RAM of FIG. 6.

FIG. 7 is an explanatory diagram showing the contents of the RAM 74 of FIG. 6. A variety of data, such as ADCR, TNSBUF, TNEMPC, STNR, STEND, and so on, which will be explained later, are stored and reviewed by new data in RAM 74.

Figure 8:
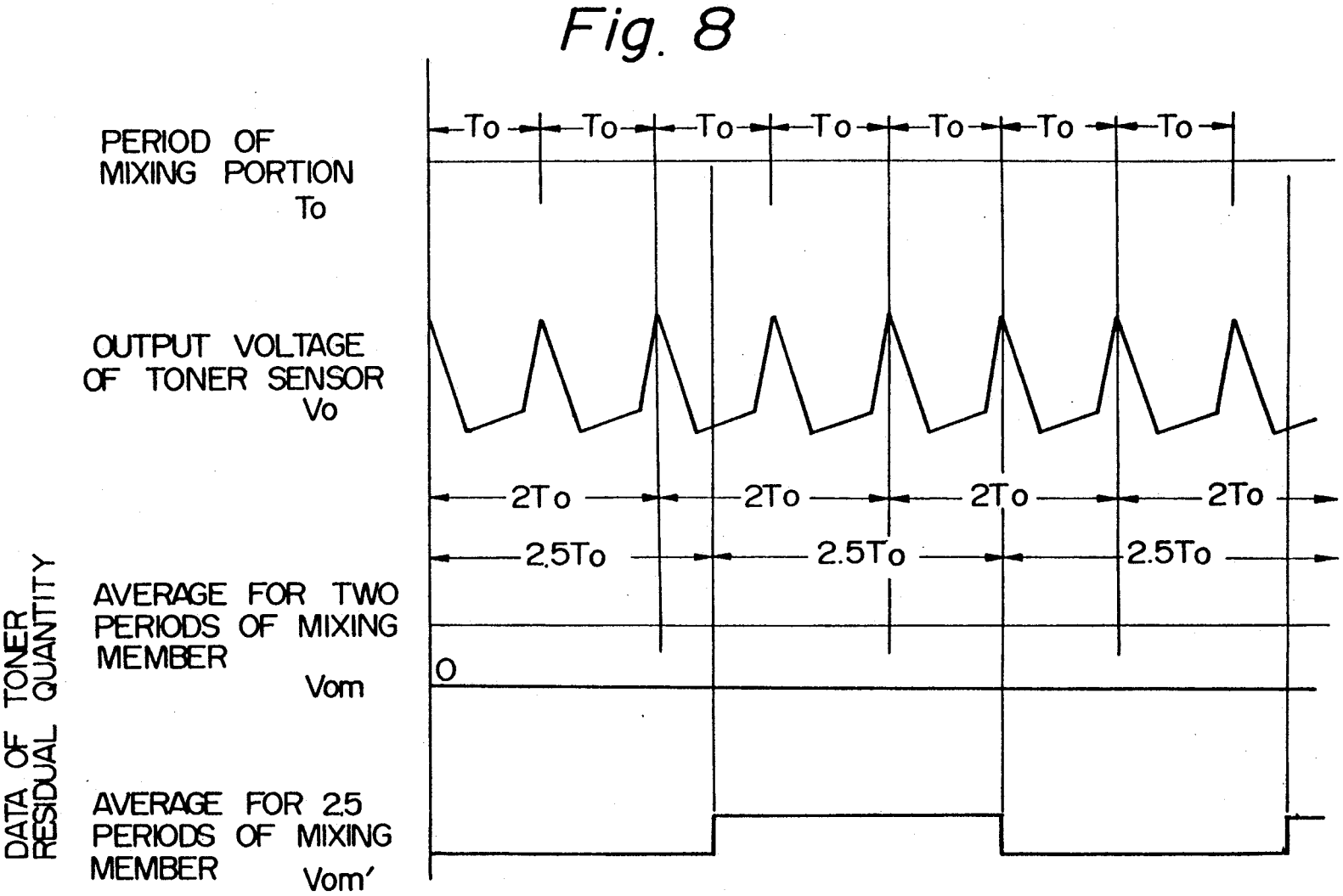
FIG. 8 is a diagram showing the relationship between rotational periods of the mixing member and the output of the toner sensor according to the present invention.

FIG. 8 is a diagram showing the relationship between the rotational speed of the mixing member 11 and the output voltage Vo of the toner sensor 30 in detecting the residual quantity of the toner 9. When the mixing member 11 is rotated at a constant speed, the output voltage Vo of the toner sensor 30 forms a regular waveform during a rotational period of the mixing member 11 due to a balance between the movement of the toner 9 and the responding speed of the toner sensor 30. When the output voltage Vo of the toner sensor 30 is sampled several times at fixed intervals and averaged to provide data for the residual quantity of the toner 9, sudden fluctuations in the output voltage Vo of the toner sensor 30 are absorbed to stabilize the data for the residual quantity of the toner 9.

The period of the waveform of the output voltage Vo of the toner sensor 30 agrees with the rotational period of the mixing member 11, so that the data for the residual quantity of the toner 9 may be more stabilized and may be more reliable if a period for averaging the sampled values is set to be substantially a random number times the rotational period of the mixing member 11. In FIG. 8, the term Vom represents the averaged value (data for the residual quantity of the toner 9) calculated with an averaging period of twice the rotational period of the mixing member 11, and the term Vom' represents an averaged value (data for the residual quantity of the toner 9) calculated with an averaging period of 2.5 times the rotational period of the mixing member 11. With the averaging period of twice the rotational period, the data for the residual quantity of the toner 9 is constant. On the other hand, with an averaging period of 2.5 times the rotational period, the data for the residual quantity of the toner 9 pulsates.

Figure 9:
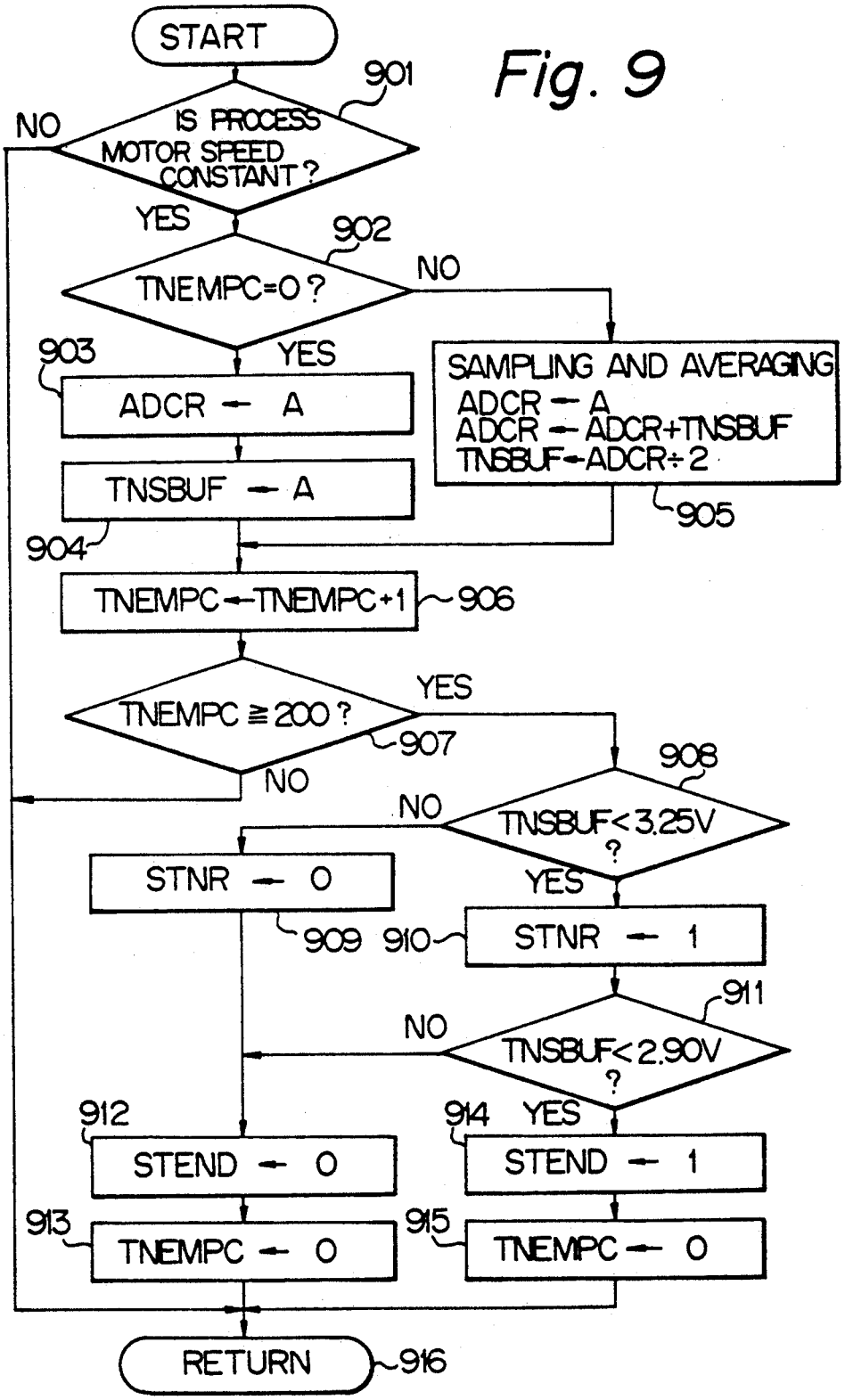
FIG. 9 is a flowchart showing one embodiment of the method of detecting the residual quantity of the toner according to the present invention.

FIG. 9 is a flowchart showing one embodiment of the method cf detecting the residual quantity of the toner according to the present invention executed during each toner sampling period. The detecting period of the toner amount is 1.2 sec., which is a random number times the mixing period, i.e., one rotational time of the mixing member 11, and the number of samplings is 200 times per 1.2 sec. In this embodiment a new sampled value ADCR in the processor 7, which is equal to the output value A of the A/D converter 6, and a previous average TNSBUF are averaged as follows:

$$TNSBUF \leftarrow (ADCR + TNSBUF)/2.$$

The CPU 72 of the signal processing portion 7 monitors whether or not the rotational speed of the process motor 3 is constant, so that at step 901, it is determined whether or not the process motor speed is constant. When the rotational speed detecting portion 5 provides a constant speed signal CVE and when it a sampling time arrives, the CPU 72 checks to see whether or not an empty counter TNEMPC (initially 0) stored in the RAM 74 is 0, thereby it is determined whether or not the empty counter TNEMPC is equal to 0 at step 902.

At first, the result of the determination at step 902 will be "YES" because the empty counter TNEMPC is set to 0 after the initialization, so that the control proceeds to step 903. An output A of the AD converter 6 is set in the RAM 74 as ADCR at step 903 and as TNSBUF at step 904.

If the process is not in the initial stage, i.e., the empty counter is not 0 at step 902, the control proceeds to step 905. At step 905, the output A of the AD converter 6 is read at a sampling time and set as ADCR, and the TNSBUF indicating the residual quantity of the toner is updated as follows:

$$ADCR \leftarrow A$$

$$ADCR \leftarrow ADCR + TNSBUF$$

$$TNSBUF \leftarrow ADCR \div 2.$$

At step 906, the empty counter TNEMPC is incremented by +1 (TNEMPC+1) and at step 907, it is determined whether or not the count value of the empty counter TNEMPC is more than or equal to 200, i.e., whether or not the sampled value averaging period of 1.2 sec. has passed. If the empty counter TNEMPC is less than 200, the control proceeds to step 916 and this routine is completed. Then the steps starting from step 901 are repeated after the sampling time and steps 901 to 907 are repeated until the counter TNEMPC counts 200.

If the counter TNEMPC is more than or equal to 200 at step 907, the control proceeds to step 908 and it is determined whether or not the TNSBUF, which is indicating the threshold value of 3.25 V at step 908. If TNSBUF≧3.25 V, the control proceeds to step 909, 912 and 913 accordingly in which a near empty flag STNR (initially 0), a toner end flag STEND (initially 0), and the empty counter TNEMPC are cleared to 0. Then the control proceeds to step 916 to complete this routine, and the steps starting from step 901 are repeated.

As the toner is consumed, the TNSBUF indicating the residual quantity of the toner may become smaller than the near empty threshold value of 3.25 V. Then, if TNSBUF<3.25 V at step 908, the control proceeds to step 911 in which the near empty flag STNR is set to 1, and a toner near the end detected signal is provided to display this situation on a display portion of the apparatus which will be explained later.

At step 911, it is determined whether or not the TNSBUF is smaller than an empty threshold value of 2.90 V, and if TNSBUF≧2.90 V, the control proceeds to step 912 and 913 and a toner end flag STEND (initially 0), and the empty counter TNEMPC are cleared to 0.

If the toner is not replenished and is further consumed, and if the value TNSBUF indicating the residual quantity of the toner becomes smaller than the empty threshold value of 2.90 V, the indication of step 911 will be "YES." If TNSBUF <2.90 V, the control proceeds to step 914 and the toner end flag STEND is then set to 1, and a toner end detected signal is provided to display this situation on the display portion of the apparatus, which will be explained later.

Then at step 915, the empty counter TNEMPC is cleared to 0, and this routine is completed at step 916.

When the residual quantity or density of the toner is first sampled after the mixing member 11 reaches a specific constant speed and turns at least one round, the toner which has gathered in clods will be separated into particles, and the toner which has stuck to the walls will be removed to provide more stabilized data for the residual quantity of the toner.

Figure 10:
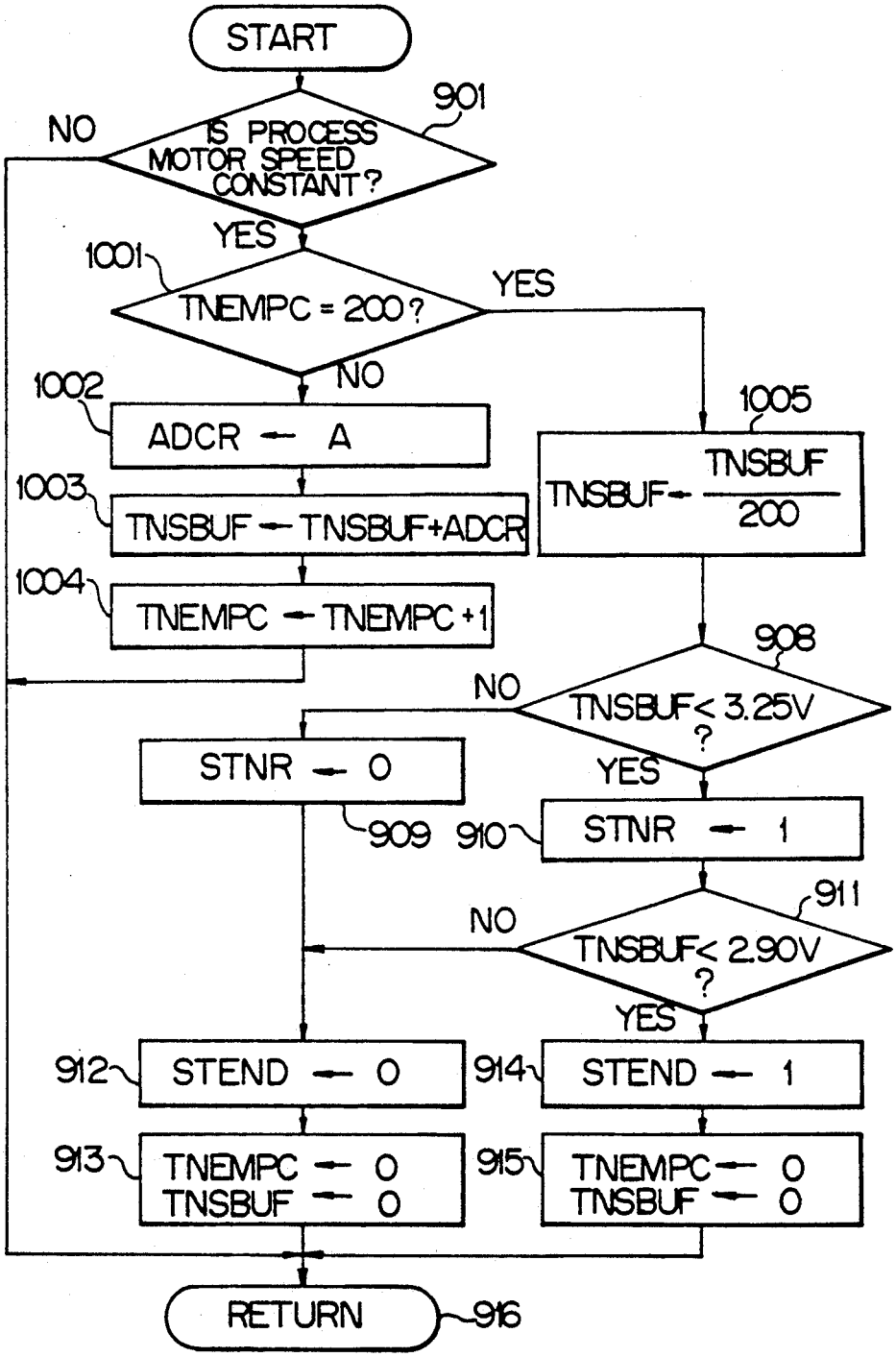
FIG. 10 is a flowchart showing another embodiment of the method of detecting the residual quantity of the toner according to the present invention.

FIG. 10 is a flowchart showing another embodiment of the method of detecting the residual quantity of the toner according to the present invention. In this embodiment, only the calculation of the value TNSBUF indicating the residual quantity of the toner is different from the embodiment shown in FIG. 9, so that the same steps as in FIG. 9 indicate the same step number. In the former embodiment, the residual quantity of the toner indicating value TNSBUF is calculated at every sampling time period, although it is calculated at every sampled value averaging period of 1.2 sec.

Accordingly, in this embodiment, it is determined whether or not the empty counter TNEMPC is equal to the number of sampling times of 200 in 1.2 sec. at step 1001 after the execution of step 901. If TNEMPC≠200, the control proceeds to steps 1002, 1003 and 1004. At step 1002, the output A of the AD converter 6 is read and set as AECR, and at step 1003, the TNSBUF indicating the residual quantity of the toner is accumulated by ADCR as follows:

TNSBUF←TNSBUF+ADCR.

Then at step 1004, the empty counter TNEMPC is incremented by +1 (TNEMPC+1) and this routine is completed at step 916.

On the other hand, if the empty counter TNEMPC is equal to the number of sampling times of 200 in 1.2 sec. at step 1001, the control proceeds to step 1005 in which the residual quantity of the toner indicating value TNSBUF, which is 200 accumulation of ADCR, is divided by 200 to calculate the average value of the output A of the AD converter 6. Explanation of steps 908 to 916 is omitted here since these step have already been explained in connection with FIG. 9.

Figure 11:
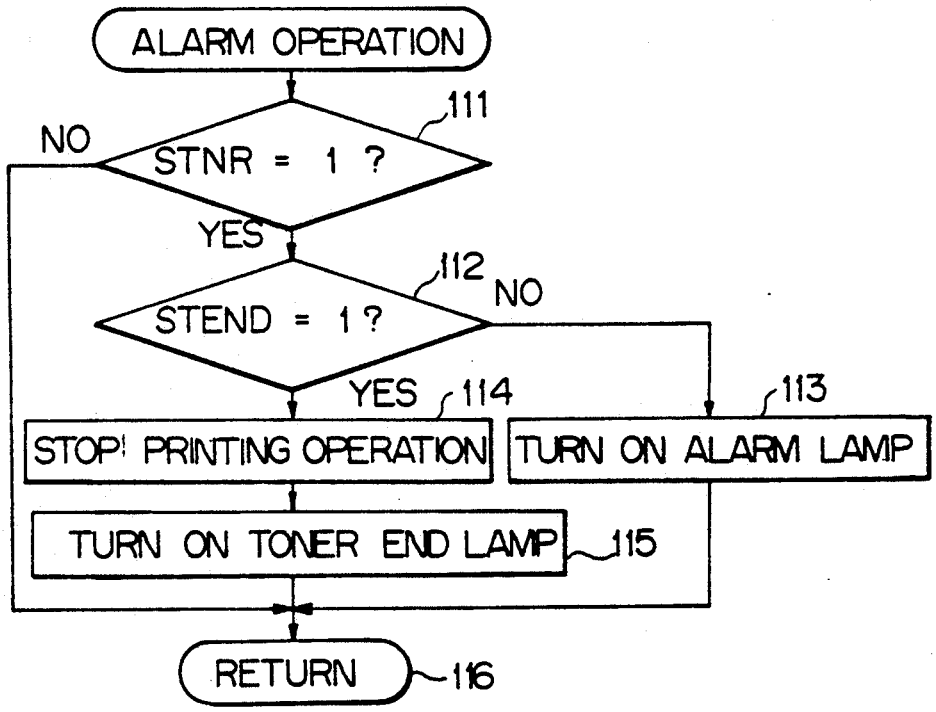
FIG. 11 is a flowchart showing one embodiment of an alarm operation when the amount of the toner is less than the predetermined value according to the present invention.

FIG. 11 is a flowchart showing one embodiment of an alarm operation when the amount of the toner is less than the predetermined value according to the present invention. At step 111, it is determined whether or not the near empty flag STNR is equal to I. If STNR≠1 at step 1111, this routine is completed at step 116, but if STNR=1 at step the control proceeds to step 112 to determine whether or not the toner end flag STEND is equal to 1.

If STEND≠1 at step 112, the control proceeds to step 13 in which an alarm lamp is turned ON to indicate that the amount of toner is decreased. And if STEND=1 at step 112, the control proceeds to steps 114 and 115. At step 114, the printing operation of the image forming device is stopped and at step 115, the toner end lamp is turned ON to indicate the need for replenishment of the toner or the exchange of the toner container.

Figure 12:
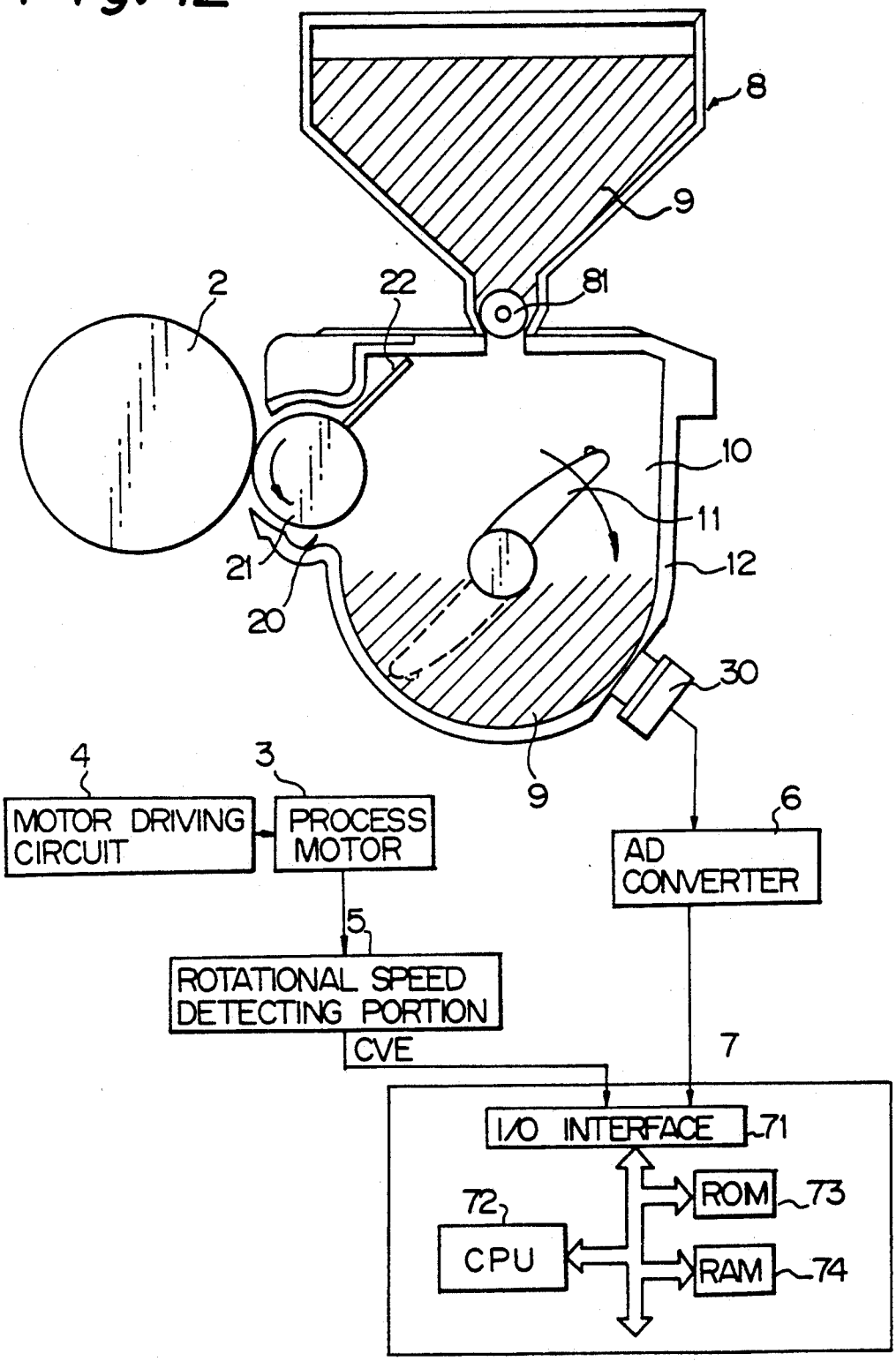
FIG. 12 is a schematic view showing another embodiment of the apparatus according to the present invention.

The embodiment mentioned above detects the residual quantity of the toner. The sample arrangement is applicable for detecting the density of the toner. FIG. 12 is a schematic view showing an embodiment of the apparatus for detecting the density of the toner according to the present invention. In this embodiment, a toner replenishing container 8 which has a toner feed roller 81 at the bottom thereof is added on top of the toner container 12. The container 8 contains a quantity of the toner 9.

Figure 13:
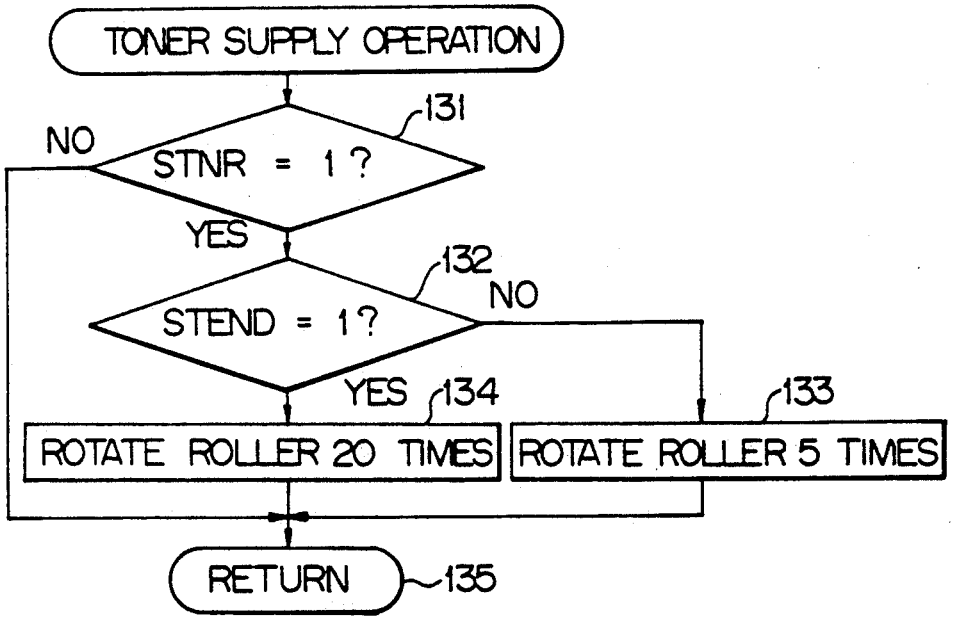
FIG. 13 is a flowchart showing one embodiment of a toner supply operation according to the present invention.

FIG. 13 is a flowchart showing one embodiment of a toner supply operation of the image forming device shown in FIG. 12. At step 131, it is determined whether or not the near empty flag STNR is equal to 1. If STNR≠1 at step 131, this routine is completed at step 135, but if STNR=1 at step 131, the control proceeds to step 132 to determine whether or not the toner end flag STEND is equal to 1.

If STEND≠1 at step 132, the control proceeds to step 133 in which the toner feed roller 81 is rotated 5 times to feed a small amount of toner 9 to the toner container 12. And if STEND=1 at step 132, the control proceeds to step 134 in which the toner feed roller 81 is rotated 20 times to feed a large amount of the toner 9 to the toner container 12.

The embodiment mentioned above observes whether or not the residual quantity of the toner has become smaller than the near empty threshold or the empty threshold, and if it is smaller than one of them, provides the toner near end signal or the toner end signal. Instead, the value TNSBUF indicating the residual quantity of the toner may be provided.

Although the invention has been explained with reference to the embodiments, the invention allows various modifications without departing from the spirit of the invention described in the claims. These modifications are understood to be within the scope of the invention.

As mentioned above, after the mixing member reaches a specific rotational speed and after the output voltage Vo of the toner sensor provides a regular waveform, the invention averages sampled values to provide data for the residual quantity or density of toner. This data for the residual quantity or density of the toner provided by the invention is stabilized because the data is not influenced by the rotation or stopping point of the mixing member.

After the mixing member reaches a specific speed and turns at least one further rotation, the invention starts to sample the residual quantity or density of the toner, so that the clods of toner will have been separated into particles and the toner sticking to walls will have been removed, thereby providing more stabilized data for the residual quantity or density of the toner.

The invention averages sampled values of the output voltage of the sensor for a period that is a random number times a rotational period of the mixing member, to provide data for the residual quantity or density of the toner. Namely, the output voltage of the toner sensor that fluctuates is sampled at various temporal points and averaged to provide stabilized data for the residual quantity or density of the toner. The averaged residual quantity of the toner is compared with a near empty value or an empty value to correctly provide a toner near end signal or a toner end signal.

What is claimed is:

1. A method of detecting the residual quantity of toner in a developing unit of an image forming device by using an output signal of a toner sensor disposed at a toner mixing portion having a mixing member to be turned for mixing and frictionally charging the toner, said method comprising the steps of:

detecting a rotational speed of the mixing member;

determining whether or not the rotational speed of the mixing member is a specific constant speed;

sampling the output voltage of the toner sensor at every predetermined sampling time period while the rotational speed of the mixing member is at the specific constant speed, said sampling being conducted without regard to the rotational position of the mixing member;

accumulating the sampled voltages and counting the number of sampled voltages which have been accumulated;

determining whether or not the number of accumulated voltages is equal to a predetermined number;

dividing the accumulated sampled voltages by the predetermined number for obtaining an average value of the sampled voltage when the accumulated number is equal to the predetermined number; and judging the residual quantity of the toner in the developing unit by the average value of the sampled voltage.

2. A method as set forth in claim 1, wherein the sampling step of the output voltage of the toner sensor is started after the mixing member has reached the specific constant speed and has made at least one further rotation.

3. A method as set forth in claim 1, wherein the predetermined number is substantially equal to a random number times the rotational period of the mixing member.

4. A method as set forth in claim 1, wherein the judging step of the the residual quantity of the toner comprises the steps:

determining whether or not the average value of the sampled voltage is less than or equal to a first threshold level;

determining whether or not the average value of the sampled voltage is less than or equal to a second threshold level, which is less than the first threshold level;

outputting a near empty signal when the average value of the sampled voltage is less than or equal to the first threshold level; and outputting a toner end signal when the average value of the sampled voltage is less than or equal to the second threshold level.

5. A method as set forth in claim 4, further comprising the steps:

turning ON a near empty lamp when the near empty signal is output; and turning ON a toner end lamp or stopping the printing operation when the toner end signal is output.

6. A method of detecting the residual quantity of toner in a developing unit of an image forming device by using an output signal of a toner sensor disposed at a toner mixing portion having a mixing member to be turned for mixing and frictionally charging the toner, said method comprising the steps of:

detecting a rotational speed of the mixing member;

determining whether or not the rotational speed of the mixing member is a specific constant speed;

sampling the output voltage of the toner sensor at every predetermined sampling time period while the rotational speed of the mixing member is at the specific constant speed, said sampling being conducted without regard to the rotational position of the mixing member;

storing the first sampled output voltage of the toner sensor during a reference period for detecting the toner quantity as a first average value;

calculating a new average value after the first average value by adding the sampled output voltage of the toner sensor to the old average value and dividing the added value by 2;

counting the number of times the sampling step is executed;

determining whether or not the number of times the sampling step has been executed is equal to predetermined number; and judging the residual quantity of the toner in the developing unit by the average value of the sampled voltage when the number of times the sampling step has been executed is equal to the predetermined number.

7. A method as set forth in claim 6, wherein the sampling step of the output voltage of the toner sensor is started after the mixing member has reached the specific constant speed and has made at least one further rotation.

8. A method as set forth in claim 6, wherein predetermined times is substantially equal to a random number number the rotational period of the mixing member.

9. A method as set forth in claim 6, wherein the judging step of the the residual quantity of the toner comprises the steps:

determining whether or not the average value of the sampled voltage is less than or equal to a first threshold level;

determining whether or not the average value of the sampled voltage is less than or equal to a second threshold level, which is less than the first threshold level;

outputting a near empty signal when the average value of the sampled voltage is less than or equal to the first threshold level; and outputting a toner end signal when the average value of the sampled voltage is less than or equal to the second threshold level.

10. A method as set forth in claim 9, further comprising the steps:

turning ON a near empty lamp when the near empty signal is output; and turning ON a toner end lamp or stopping the printing operation when the toner end signal is output.

11. A method of detecting the residual quantity of toner in a developing unit of an image forming device with a toner replenishment container on the upper part thereof, by using an output signal of a toner sensor disposed at a toner mixing portion having a mixing member to be turned for mixing and frictionally charging the toner, said method comprising the steps of:

detecting a rotational speed of the mixing member;

determining whether or not the rotational speed of the mixing member is a specific constant speed;

sampling the output voltage of the toner sensor at every predetermined sampling time period while the rotational speed of the mixing member is at the specific constant speed, said sampling being conducted without regard to the rotational position of the mixing member;

accumulating the sampled voltages and counting the number of sampled voltages which have been accumulated;

determining whether or not the number of accumulated voltages is equal to a predetermined number;

dividing the accumulated sampled voltages by the predetermined number for obtaining an average value of the sampled voltage when the accumulated number is equal to the predetermined number; and judging the residual quantity of the toner in the developing unit by the average value of the sampled voltage.

12. A method as set forth in claim 11, wherein the sampling step of the output voltage of the toner sensor is started after the mixing member has reached a specific constant speed and has made at last one further rotation.

13. A method as set forth in claim 11, wherein the predetermined number is substantially equal to a random number times the rotational period of the mixing member.

14. A method as set forth in claim 11, wherein the judging step of the the residual quantity of the toner comprises the steps:

determining whether or not the average value of the sampled voltage is less than or equal to a first threshold level;

determining whether or not the average value of the sampled voltage is less than or equal to a second threshold level, which is less than the first threshold level;

outputting a near empty signal when the average value of the sampled voltage is less than or equal to the first threshold level; and outputting a toner end signal when the average value of the sampled voltage is less than or equal to the second threshold level.

15. A method as set forth in claim 14, further comprising the steps:

feeding a small amount of toner from the toner replenishment container to the developing unit when the near empty signal is output; and feeding a large amount of toner from the toner replenishment container to the developing unit when the toner end signal is output.

16. A method of detecting the residual quantity of toner in a developing unit of an image forming device with a toner replenishment container on the upper part thereof, by using an output signal of a toner sensor disposed at a toner mixing portion having a mixing member to be turned for mixing and frictionally charging the toner, said method comprising the steps of:

detecting a rotational speed of the mixing member;

determining whether or not the rotational speed of the mixing member is a specific constant speed;

sampling the output voltage of the toner sensor at every predetermined sampling time period while the rotational speed of the mixing member is at the specific constant speed, said sampling being conducted without regard to the rotational position of the mixing member;

storing the first sampled output voltage of the toner sensor during a reference period for detecting the toner quantity as a first average value;

calculating a new average value after the first average value by adding the sampled output voltage of the toner sensor to the old average value and dividing the added value by 2;

counting the number of times the sampling step is executed;

determining whether or not the number of times the sampling step has been executed is equal to predetermined number; and judging the residual quantity of the toner in the developing unit by the average value of the sampled voltage when the number of times the sampling step has been executed is equal to the predetermined number.

17. A method as set forth in claim 16, wherein the sampling step of the output voltage of the toner sensor is started after the mixing member has reached the specific constant speed and has made at least one further rotation.

18. A method as set forth in claim 16, wherein the predetermined number is substantially equal to a random number times the a rotational period of the mixing member.

19. A method as set forth in claim 16, wherein the judging step of the the residual quantity of the toner comprises the steps:

determining whether or not the average value of the sampled voltage is less than or equal to a first threshold level;

determining whether or not the average value of the sampled voltage is less than or equal to a second threshold level, which is less than the first threshold level;

outputting a near empty signal when the average value of the sampled voltage is less than or equal to the first threshold level; and outputting a toner end signal when the average value of the sampled voltage is less than or equal to the second threshold level.

20. A method as set forth in claim 19, further comprising the steps:

feeding a small amount of toner from the toner replenishment container to the developing unit when the near empty signal is output; and feeding a large amount of tone from the toner replenishment container to the developing unit when the toner end signal is output.

21. An apparatus for detecting the residual quantity of toner in a developing unit of an image forming device by using an output signal of a toner sensor disposed at a toner mixing portion having a mixing member to be turned for mixing and frictionally charging the toner, said apparatus comprising:

means for detecting a rotational speed of the mixing member;

means for determining whether or not the rotational speed of the mixing member is a specific constant speed;

means for sampling the output voltage of the toner sensor at every predetermined sampling time period while the rotational speed of the mixing member is at the specific constant speed, said sampling means being operable for sampling said output voltage without regard to the rotational position of the mixing member;

means for accumulating the sampled voltages and counting the number of sampled voltages which have been accumulated means for determining whether or not the number of accumulated voltages is equal to a predetermined number;

means for dividing the accumulated sampled voltages by the predetermined number for obtaining an average value of the sampled voltage when the accumulated number is equal to the predetermined number; and means for judging the residual quantity of the toner in the developing unit by the average value of the sampled voltage.

22. An apparatus as set forth in claim 21, wherein the means for sampling the output voltage of the toner sensor is started after the mixing member has reached a specific constant speed and has made at least one further rotation.

23. An apparatus as set forth in claim 21, wherein the predetermined number is substantially equal to a random number times the rotational period of the mixing member.

24. An apparatus as set forth in claim 21, wherein the means for judging the residual quantity of the toner comprises:

means for determining whether or not the average value of the sampled voltage is less than or equal to a first threshold level;

means for determining whether or not the average value of the sampled voltage is less than or equal to a second threshold level, which is less than the first threshold level;

means for outputting a near empty signal when the average value of the sampled voltage is less than or equal to the first threshold level; and means for outputting a toner end signal when the average value of the sampled voltage is less than or equal to the second threshold value.

25. An apparatus as set forth in claim 24, further comprising:

means for turning ON a near empty lamp when the near empty signal is output; and means for turning ON a toner end lamp or stopping the printing operation when the toner end signal is output.

26. An apparatus for detecting the residual quantity of toner in a developing unit of an image forming device by using an output signal of a toner sensor disposed at a toner mixing portion having a mixing member to be turned for mixing and frictionally charging the toner, said apparatus comprising:

means for detecting a rotational speed of the mixing member;

means for determining whether or not the rotational speed of the mixing member is a specific constant speed;

means for sampling the output voltage of the toner sensor at every predetermined sampling time period while the rotational speed of the mixing member is at the specific constant speed, said sampling means being operable for sampling said output voltage without regard to the rotational position of the mixing member;

means for storing the first sampled output voltage of the toner sensor during a reference period for detecting the toner quantity as a first average value;

means for calculating a new average value after the first average value by adding the sampled output voltage of the toner sensor to the old average value and dividing the added value by 2;

means for counting the number of times the sampling step is executed by the sampling means;

means for determining whether or not the number of times the sampling step has been executed is equal to predetermined number; and means for judging the residual quantity of the toner in the developing unit by the average value of the sampled voltage when the number of times the sampling step has been executed is equal to the predetermined number.

27. An apparatus as set forth in claim 26, wherein the means for sampling the output voltage of the toner sensor is started after the mixing member has reached a specific constant speed and has made at least one further rotation.

28. An apparatus as set forth in claim 26, wherein the predetermined number is substantially equal to a random number times the rotational period of the mixing member.

29. An apparatus as set forth in claim 26, wherein the means for judging the residual quantity of the toner comprises:

means for determining whether or not the average value of the sampled voltage is less than or equal to a first threshold level;

means for determining whether or not the average value of the sampled voltage is less than or equal to a second threshold level, which is less than the first threshold level;

means for outputting a near empty signal when the average value of the sampled voltage is less than or equal to the first threshold level; and means for outputting a toner end signal when the average value of the sampled voltage is less than or equal to the second threshold value.

30. An apparatus as set forth in claim 29, further comprising:

means for turning ON a near empty lamp when the near empty signal is output; and means for turning ON a toner end lamp or stopping the printing operation when the toner end signal is output.

31. An apparatus for detecting the residual quantity of toner in a developing unit of an image forming device with a toner replenishment container on the upper part thereof, by using an output signal of a toner sensor disposed at a toner mixing portion having a mixing member to be turned for mixing and frictionally charging the toner, said apparatus comprising:

means for detecting a rotational speed of the mixing member;

means for determining whether or not the rotational speed of the mixing member is a specific constant speed;

means for sampling the output voltage of the toner sensor at every predetermined sampling time period while the rotational speed of the mixing member is at the specific constant speed, said sampling means being operable for sampling said output voltage without regard to the rotational position of the mixing member;

means for accumulating the sampled voltages and counting the number of sampled voltages which have been accumulated means for determining whether or not the number of accumulated voltages is equal to a predetermined number;

means for dividing the accumulated sampled voltages by the predetermined number for obtaining an average value of the sampled voltage when the accumulated number is equal to the predetermined number; and means for judging the residual quantity of the toner in the developing unit by the average value of the sampled voltage.

32. An apparatus as set forth in claim 31, wherein the means for sampling the output voltage of the toner sensor is started after the mixing member has reached a specific constant speed and has made at least one further rotation.

33. An apparatus as set forth in claim 31, wherein the predetermined number is substantially equal to a random number times the rotational period of the mixing member.

34. An apparatus as set forth in claim 31, wherein the means for judging the residual quantity of the toner comprises:

means for determining whether or not the average value of the sampled voltage is less than or equal to a first threshold level;

means for determining whether or not the average value of the sampled voltage is less than or equal to a second threshold level, which is less than the first threshold level;

means for outputting a near empty signal when the average value of the sampled voltage is less than or equal to the first threshold level; and means for outputting a toner end signal when the average value of the sampled voltage is less than or equal to the second threshold.

35. An apparatus as set forth in claim 34, further comprising:

means for feeding a small amount of toner from the toner replenishment container to the developing unit when the near empty signal is output; and means for feeding a large amount of toner from the toner replenishment container to the developing unit when the toner end signal is output.

36. An apparatus for detecting the residual quantity of toner in a developing unit of an image forming device with a toner replenishment container on the upper part thereof, by using an output signal of a toner sensor disposed at a toner mixing portion having a mixing member to be turned for mixing and frictionally charging the toner, said apparatus comprising:

means for put detecting a rotational speed of the mixing member;

means for determining whether or not the rotational speed of the mixing member is a specific constant speed;

means for sampling the output voltage of the toner sensor at every predetermined sampling time period while the rotational speed of the mixing member is at the specific constant speed, said sampling means being operable for sampling said output voltage without regard to the rotational position of the mixing member;

means for storing the first sampled output voltage of the toner sensor during a reference period for detecting the toner quantity as a first average value;

means for calculating a new average value after the first average value by adding the sampled output voltage of the toner sensor to the old average value and dividing the added value by 2;

means for counting the number of times the sampling step is executed by the sampling means;

means for determining whether or not the number of times the sampling step has been executed is equal to predetermined number; and means for judging the residual quantity of the toner in the developing unit by the average value of the sampled voltage when the number of times the sampling step has been executed is equal to the predetermined number.

37. An apparatus as set forth in claim 36, wherein the means for sampling the output voltage of the toner sensor is started after the mixing member has reached a specific constant speed and has made at least one further rotation.

38. An apparatus as set forth in claim 36, wherein the predetermined number is substantially equal to a random number times the rotational period of the mixing member.

39. An apparatus as set forth in claim 36, wherein the means for judging the residual quantity of the toner comprises:

means for determining whether or not the average value of the sampled voltage is less than or equal to a first threshold level;

means for determining whether or not the average value of the sampled voltage is less than or equal to a second threshold level, which is alios than the first threshold level;

means for outputting a near empty signal when the average value of the sampled voltage is less than or equal to the first threshold level; and means for outputting a toner end signal when the average value of the sampled voltage is less than or equal to the second threshold level.

40. An apparatus as set forth in claim 39, further comprising:

means for feeding a small amount of toner form the toner replenishment container to the developing unit when the near empty signal is output; and means for feeding a large amount of toner from the toner replenishment container to the developing unit when the toner end signal is output.

* * * * *